US012076636B2

(12) United States Patent
Carr

(10) Patent No.: US 12,076,636 B2
(45) **Date of Patent: *Sep. 3, 2024**

(54) COUNTER-ROTATING FIN STEERING SYSTEM FOR BOARD SPORTS

(71) Applicant: Brian Carr, Boston, MA (US)

(72) Inventor: Brian Carr, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/177,306

(22) Filed: Mar. 2, 2023

(65) Prior Publication Data

US 2023/0201700 A1 Jun. 29, 2023

Related U.S. Application Data

(63) Continuation of application No. 17/288,584, filed as application No. PCT/US2020/060122 on Nov. 12, 2020, now Pat. No. 11,617,937.

(60) Provisional application No. 62/961,244, filed on Jan. 15, 2020.

(51) Int. Cl.

| | |
|---|---|
| ***A63C 5/06*** | (2006.01) |
| ***A63C 5/03*** | (2006.01) |
| ***A63C 5/04*** | (2006.01) |
| ***A63C 5/12*** | (2006.01) |
| ***A63C 10/00*** | (2012.01) |
| ***A63C 10/14*** | (2012.01) |
| ***A63C 10/18*** | (2012.01) |

(52) U.S. Cl.

CPC ..... *A63C 5/06* (2013.01); *A63C 5/03* (2013.01); *A63C 5/0417* (2013.01); *A63C 5/128* (2013.01); *A63C 10/00* (2013.01); *A63C 10/14* (2013.01); *A63C 10/18* (2013.01); *A63C 2203/40* (2013.01); *A63C 2203/52* (2013.01); *A63C 2203/54* (2013.01)

(58) Field of Classification Search

CPC ..... A63C 5/03; A63C 5/06; A63C 5/0417; A63C 10/00; A63C 10/14; A63C 17/018; A63C 2203/40; A63C 2203/52; A63C 2203/54

See application file for complete search history.

(56) References Cited

U.S. PATENT DOCUMENTS

| | | | | |
|---|---|---|---|---|
| 6,579,134 | B1 | 6/2003 | Fiebing | |
| 11,617,937 | B2 * | 4/2023 | Carr | A63C 10/00 280/14.22 |
| 2012/0161422 | A1 * | 6/2012 | Elliott | A63C 7/04 280/604 |

FOREIGN PATENT DOCUMENTS

| | | | |
|---|---|---|---|
| CN | 208448602 | U | 2/2019 |
| DE | 202011108482 | U1 | 1/2012 |

* cited by examiner

*Primary Examiner* — Brian L Swenson
(74) *Attorney, Agent, or Firm* — Anderson Gorecki LLP

(57) ABSTRACT

A steering system for a snowboard includes two binding interface pods, one of which may be active and one of which may be passive. Rotation or tilting of a top plate of the active binding interface pod in response to rotation or tilting of the rider's steering foot causes counter-rotation of a steering fin under the rider's steering foot. The passive binding interface pod is responsive via a linkage between the active and passive binding interface pods to cause rotation of a steering fin under the rider's non-steering foot. Coordinated counter-rotation of the steering fins causes the board to turn in the direction of rotation of the rider's steering foot when the steering fins are unaligned. Optionally, both binding pods may be active in steering, i.e. enabling two footed steering.

20 Claims, 21 Drawing Sheets

COUNTER-ROTATING FIN STEERING SYSTEM FOR BOARD SPORTS

TECHNICAL FIELD

The present disclosure is generally related to board sports such as snowboarding and more particularly to a steering system for sport boards.

BACKGROUND

A snowboard is normally steered by tilting the board to one side and adjusting the rider's weight distribution to use the edge of the board to exert force that initiates a turn to the left or right of a downhill line. The positions of the rider's head, shoulders, hips, and arms affect execution of a turn, as does the lean of the rider and distribution of force between the front and back feet. The technique can be difficult to learn and requires significant physical effort when executed inefficiently. A variety of board steering features have been conceived to help beginners learn to snowboard, but none have gained widespread popularity because they are typically difficult to use and do not necessarily help the rider learn how to steer the board in the standard manner.

U.S. Pat. No. 9,180,359 issued to Deutsch discloses a rotatable snowboard binding system allowing the front binding to rotate from the riding mode to the skating mode freely so that a rider can skate and rotate back to the riding mode. When in the skating mode, a fin member protrudes beneath the bottom of the snowboard. This acts on the snow to maintain the rider's direction of travel. The system allows both goofy foot and regular foot riders to negotiate lifts and lift lines and traverse flats by allowing the front binding to rotate between 0° (riding) and 90° (skating) positions. While in the riding mode, the removable bindings and board will function as normal. When the system is utilized in the skating mode, the front binding rotates, allowing the rider to operate the snowboard much like a skateboard. In this rotated position, the fin member protrudes from the bottom of the board.

U.S. Pat. No. 6,579,134 issued to Fiebing discloses a user-propellable sportboard device for motion over a fluid medium including a board adapted for support by a fluid medium including a top and a bottom, a plurality of fin assemblies mounted to said board with each said fin assembly including a foot platform for supporting a user's foot, said platform having a substantially vertical platform axis, about which said platform is pivoted responsive to input of force from a user's foot, a fin disposed below said bottom for transmitting force to a fluid medium said fin having a substantially vertical fin axis about which said fin is pivotable, and transmission means connecting said foot platform to said fin for pivoting said fin about its fin axis responsive to pivoting of said foot platform about its platform axis.

WO 2004018286A1 of Mackay et al discloses a removable, rotating disc wherein a person can control ride-on devices such as surfboards, body boards, wind surfers, skateboards, etc. in which the rider's foot never has to leave contact with the disc and can control a steerable fin. This can reduce learning time for beginners as well as allowing more experienced riders to perform maneuvers not possible without the accessory. Furthermore, the mounting means includes a ramp for reducing resistance for the body part to slide on the contact surface and a break for slowing or stopping rotation of the disc upon application of the break.

DE 202011108482U1 discloses kiteboards having rotating plates connected to fins to control during use in water.

U.S. Pat. No. 7,832,742 issued to Duggan discloses a foot or boot mounting for a sportboard such as a snowboard, wakeboard, mountainboard, surfboard, kiteboard, or similar article, having a tilted base plate with a bearing raceway or other means providing an axis of rotation that is inclined by a predetermined angular amount, pivotably guiding a tilted rotating plate that has a top surface tilted with respect to its axis of rotation by a predetermined angular amount. The top surface provides direct or indirect support for the bottom surface of a rider's foot. The tilt of the top surface is aligned relative to its axis of rotation such that the upward tilted portion is generally aligned toward the inside of a rider's foot. Thus, a rider's feet and body members are aligned more naturally while the rider is free to continually rotate his or her feet and change posture more comfortably.

U.S. Pat. No. 6,626,443 issued to Lafond discloses a multi-position binding system for snowboards having at least two preset positions, including a first position where the user is able to control the snowboard under conventional use and a second position where the user is able to rotate the binding systems to extend a guide blade through a slot from a recessed position within the core of the board. The blade when in use projects from the bottom surface of a snowboard to provide guide means to aid the user in controlling the direction of the snowboard during forward movement.

U.S. Pat. No. 3,290,048 issued to Masami discloses a rudder attached to a base plate for a ski rotatable up to 45 degrees in each direction, according to the skier's shifting weight, while in use and 90 degrees by displacement of the shaft in the climbing slot.

"Lumbos," kickstarter.com. Sep. 16, 2017, https://web.archive.org/web/20170916010111/https://www.kickstarter.com/projects/lumbos/snowboard-better-easier-safer-and-funner-lumbos, discloses "a new type of snowboarding accessory that mounts between your board and your bindings, allowing one's feet to rotate bi-directionally for a more free and comfortable experience."

"A Better Binding," beckmannag.com. Feb. 8, 2013, https://web.archive.org/web/20130208233023/http://beckmannag.com/machine-tools/a-better-binding, discloses flexible bindings (see images) interfaces "which will inform you very quickly if, in fact, your movements on a board are less than ideal."

SUMMARY

All examples, aspects and features mentioned in this document can be combined in any technically possible way.

In accordance with some aspects of the invention an apparatus comprises: a first binding interface pod with a first top plate and a first steering fin that counter-rotates in response to rotation of the first top plate; a second binding interface pod with a second steering fin; and a linkage that connects the first binding interface pod with the second binding interface pod; wherein the second binding pod is responsive to rotation of the first top plate to rotate the second steering fin. In some implementations n degrees of rotation of the first top plate causes counter-rotation of −n degrees of the first steering fin. In some implementations n degrees of rotation of the first top plate causes rotation of n degrees of the second steering fin. In some implementations n degrees of rotation of the first top plate causes counter-rotation of −m degrees of the first steering fin. In some implementations n degrees of rotation of the first top plate causes rotation of m degrees of the second steering fin. In some implementations the second binding interface pod comprises a second top plate and the second steering fin is configured to rotate in response to rotation of the second top plate. In some implementations the first binding pod comprises a first pulley, the second binding interface pod comprises a second pulley, and the linkage comprises first and second cables that each connect to the first and second pulleys. In some implementations the first binding interface pod comprises a first pulley, the second binding interface pod comprises a second pulley, and the linkage comprises first and second rods that each connect to the first and second pulleys. In some implementations the first binding interface pod comprises a first pulley, the second binding interface pod comprises a second pulley, and the linkage comprises a belt that connects the first and second pulleys. In some implementations the first binding pod comprises a first pulley, the second binding interface pod comprises a second pulley, and the linkage comprises a chain that connects the first and second pulleys. In some implementations the first binding interface pod is mounted to a snowboard such that the first top plate is non-parallel with a top surface of the snowboard.

In accordance with some aspects of the invention a method comprises: steering a snowboard in response to rotation of at least one foot of a rider by: a first top plate of a first binding interface pod rotating responsive to rotation of one of the rider's feet; counter-rotating a first steering fin of the first binding interface pod in response to rotation of the first top plate; and rotating a second steering fin of a second binding interface pod in response to rotation of the first top plate. Some implementations comprise counter-rotating the first steering fin of the first binding pod −n degrees in response to n degrees of rotation of the first top plate. Some implementations comprise rotating the second steering fin of the second binding pod n degrees in response to n degrees of rotation of the first top plate. Some implementations comprise counter-rotating the first steering fin of the first binding pod −m degrees in response to n degrees of rotation of the first top plate. Some implementations comprise rotating the second steering fin of the second binding interface pod m degrees in response to n degrees of rotation of the first top plate. In some implementations the second binding interface pod comprises a second top plate and the method comprises rotating the second steering fin in response to rotation of the second top plate. In some implementations the first binding interface pod comprises a first pulley, the second binding interface pod comprises a second pulley, and the method comprises rotationally linking the first pulley to the second pulley with first and second cables that each connect to the first and second pulleys. In some implementations the first binding interface pod comprises a first pulley, the second binding interface pod comprises a second pulley, and the method comprises rotationally linking the first pulley to the second pulley with first and second rods that each connect to the first and second pulleys. In some implementations the first binding interface pod comprises a first pulley, the second binding interface pod comprises a second pulley, and the method comprises rotationally linking the first pulley to the second pulley with a belt. In some implementations the first binding pod comprises a first pulley, the second binding interface pod comprises a second pulley, and the method comprises rotationally linking the first pulley to the second pulley with a chain.

In accordance with some aspects of the invention an apparatus comprises: a binding interface pod with a top plate and a steering fin that rotates in a first axis in response to pivoting of the top plate in a second axis that is orthogonal to the first axis.

DETAILED DESCRIPTION

Figure 1:
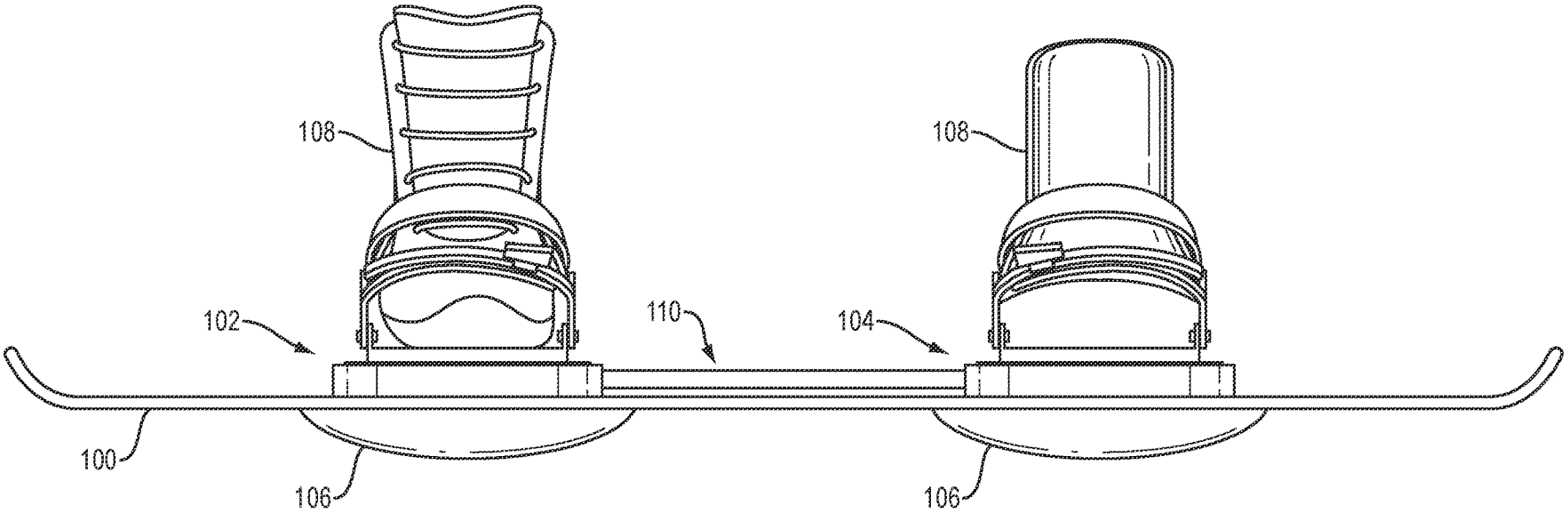
FIG. 1 illustrates a snowboard with a counter-rotating fin steering system.
Figure 2B:
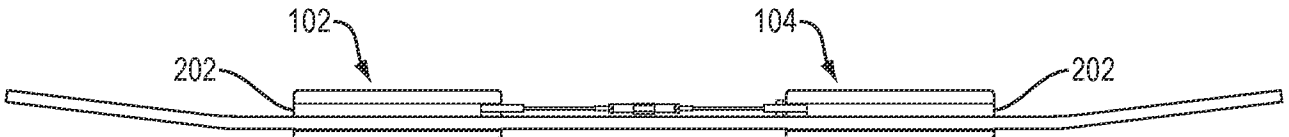
FIGS. 2A, 2B, 2C, and 2D illustrate front, side, top and perspective views of the snowboard with a counter-rotating fin steering system of FIG. 1.
Figure 2C:
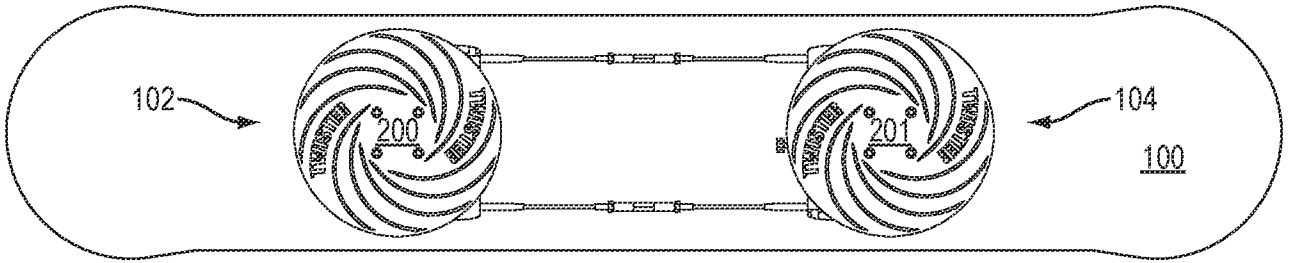
Figure 2A:
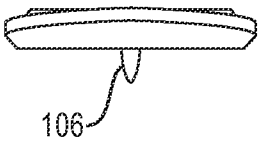
Figure 2D:
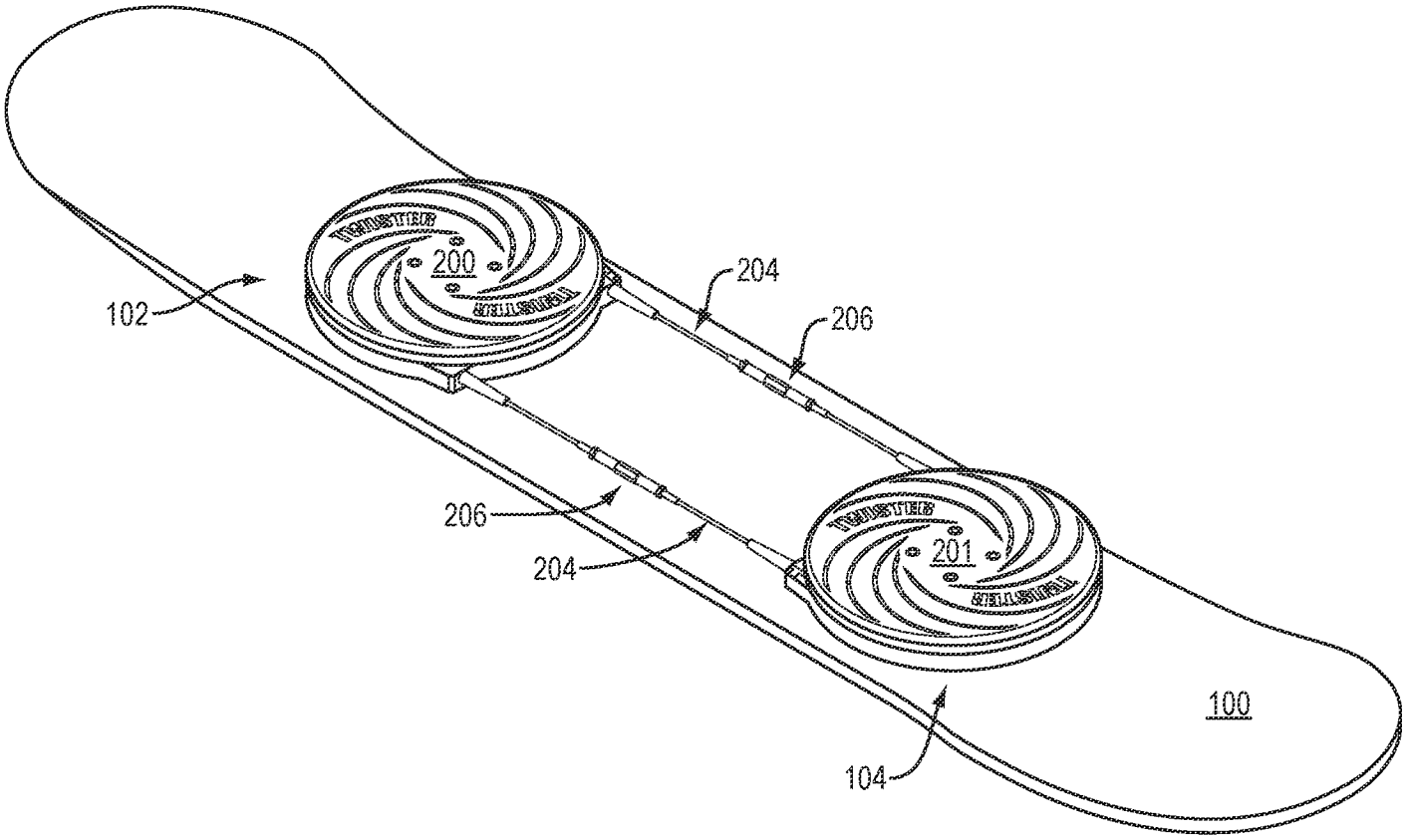

FIG. 1 illustrates a snowboard 100 with a counter-rotating fin steering system. The steering system includes two binding interface pods 102, 104 with steering fins 106. The binding interface pods are mounted at positions along the length of the board at locations at which the rider's feet are placed. Standard bindings 108 are mounted to the binding interface pods 102, 104. The rider's boots are secured in the bindings in a standard manner. The binding interface pods enable the rider to steer the snowboard 100 by rotating one foot (hereafter, the steering foot), thereby rotating the steering fins 106. The steering foot may be the back foot, which is the right foot when the board is ridden in the most common orientation. A linkage 110 between the binding interface pods 102, 104 coordinates rotation of the steering fins 106.

FIGS. 2A, 2B, 2C, and 2D illustrate front, side, top, and perspective views of a snowboard 100 with a counter-rotating fin steering system. The binding interface pods 102, 104 are substantially cylindrical in shape and include circular top plates 200 on which the bindings (not illustrated) are mounted. The top plate 200 of the active binding interface pod 102 (secured to the steering foot) is rotatable. The top plate 201 of the passive binding interface pod 104

(secured to the non-steering foot) is not rotatable. The top plates are disposed on base plates 202 that are bolted or screwed to the board 100 and do not rotate. The linkage between the binding interface pods includes two flexible cables 204 with tensioners 206. The tensioners allow cable tension to be adjusted, e.g. to take up slack that may occur due to stretching of the cables. The tensioners also help to fine-tune cable length for the distance between the binding pods, thereby allowing binding placement in accordance with rider preference. Rotation of the top plate 200 of the active binding pod 102 in a first plane causes counter-rotation of the steering fin 106 of the active binding interface pod in a second plane that is parallel to the first plance and exerts force on the cables 204 to cause coordinated rotation of the steering fin 106 of the passive binding interface pod 104.

Figure 3A:
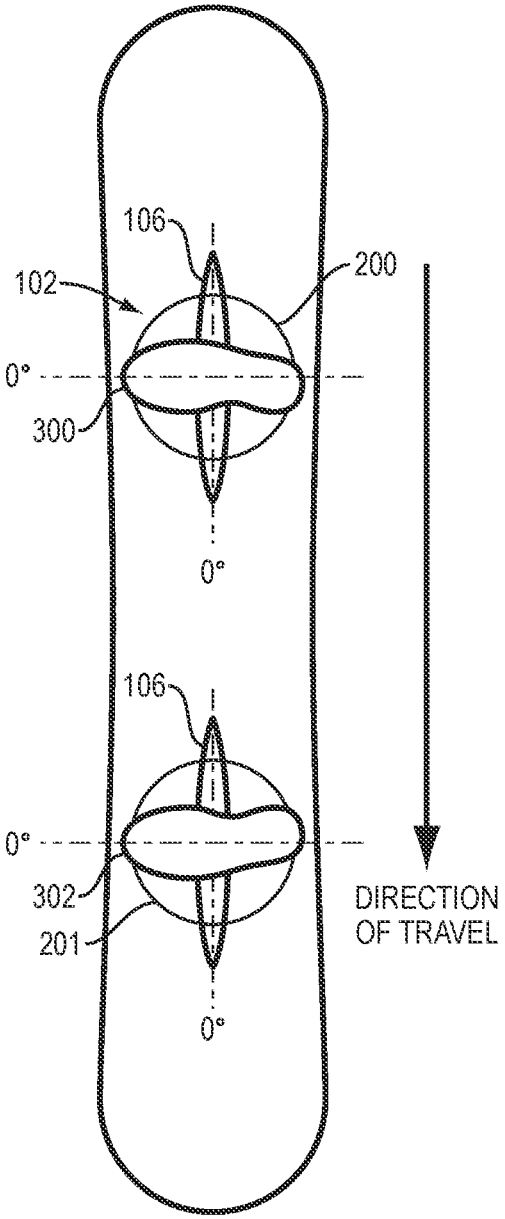
FIGS. 3A and 3B illustrate the relationship between rotation of the rider's steering foot and rotation of the steering fins.
Figure 3B:
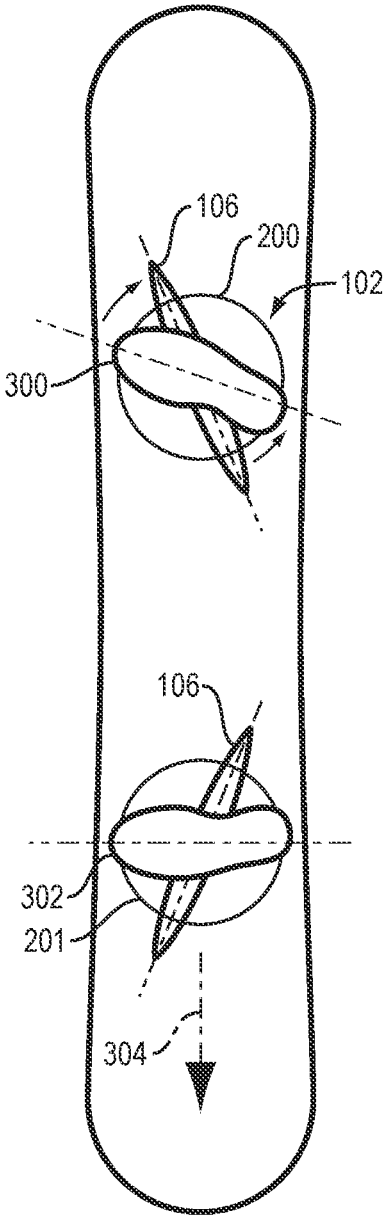

FIGS. 3A and 3B illustrate the relationship between rotation of the rider's steering feet and rotation of the steering fins. Rotational movement of the rider's steering foot 300 (right/back in the illustrated example) causes the top plate 200 of the active binding interface pod 102 to rotate in the same direction as the steering foot. Rotation of the top plate 200 causes the steering fin 106 of the active binding pod 102 to counter-rotate relative to rotation of the rider's steering foot 300, i.e. the steering foot and steering foot fin rotate in opposite directions. The rider's non-steering foot 302 (left/forward in the illustrated example) has a fixed position on top plate 201, neither of which can rotate. In order to steer the board in a straight line the rider's steering foot 300 is rotated into a position that orients the steering fins 106 lengthwise in the same axis 304 as the length dimension of the board, which is a 0 degrees position depicted in FIG. 3A. In order to steer the board to the right as shown in FIG. 3B the rider rotates the steering foot 300 to the right (CW as viewed from above), which induces CCW counter-rotation of the steering fin 106 of the active binding interface pod 102 and CW rotation of the passive binding interface pod 104 steering fin 201. Maximum steering fin rotation may be limited for safety. For example, steering fin rotation may be limited to +/−45 degrees from the 0 degrees position.

Steering fin 106 rotation may be proportional to rotation of the top plate 200 of the active binding interface pod 102. For example, n degrees of rotation of the top plate of the active binding interface pod may, but does not necessarily, translate to a rotation of −n degrees of the steering fin 106 of the active binding interface pod 102 and a rotation of n degrees of the steering fin 106 of the passive binding interface pod 104. In some implementations n degrees of rotation of the top plate of the active binding interface pod translates to a rotation of −m degrees of the steering fin of the active binding interface pod and a rotation of m degrees of the steering fin of the passive binding interface pod. Further, rotation of the passive binding interface pod steering fin may be, but is not necessarily, equal in magnitude and opposite in direction relative to the active binding interface pod steering fin. It should be noted that the orientation of the mechanisms could be reversed such that the snowboard is steered by rotating the rider's left foot rather than the right foot.

Figure 4:
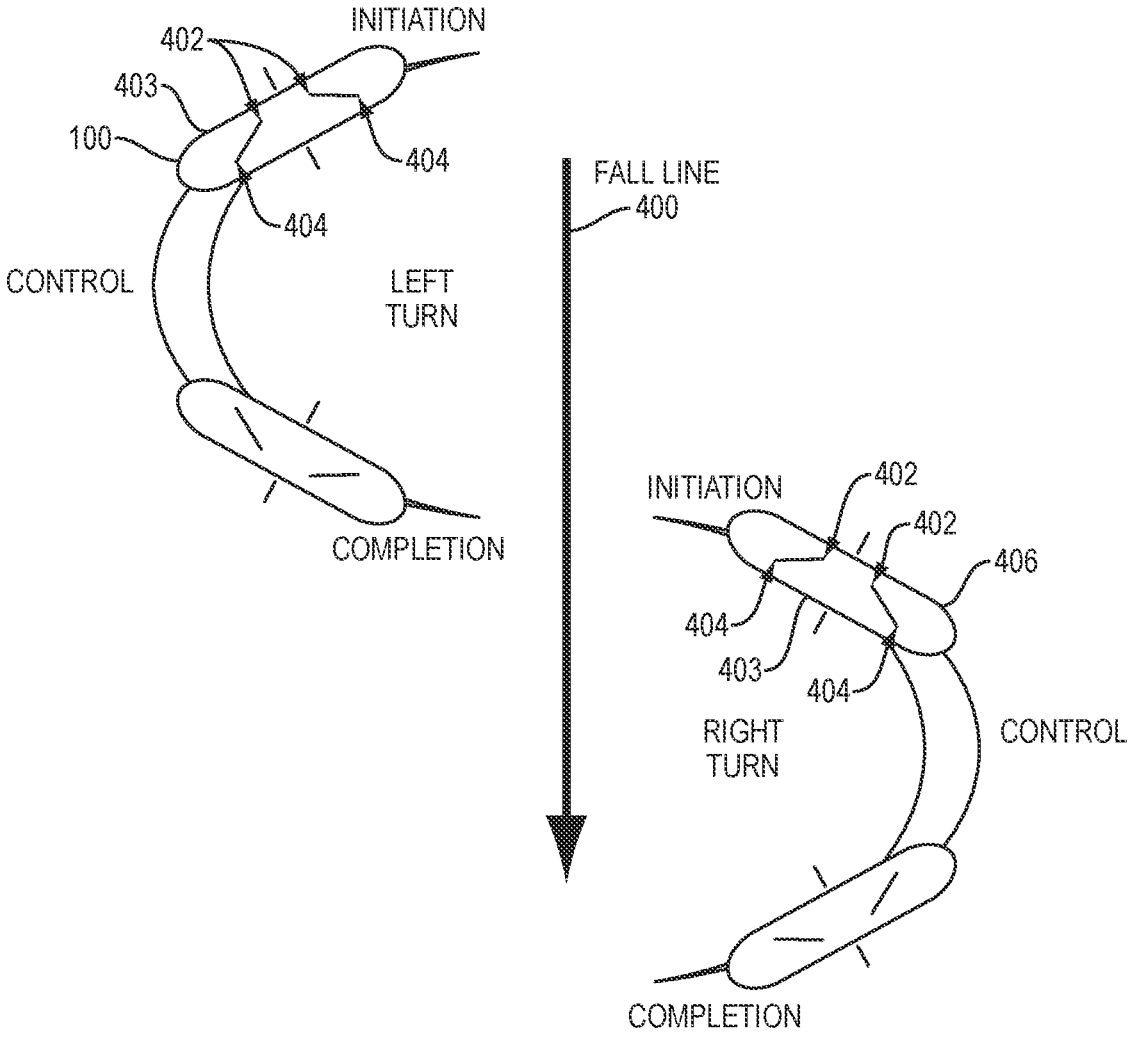
FIG. 4 illustrates orientation of the steering fins relative to the fall line during turns.

FIG. 4 illustrates orientations of the steering fins relative to the fall line 400 during turns. The board 100 turns due to force exerted against the snow by the counter-rotating steering fins. As already described above, rotation of the rider's steering foot causes rotation of both of the steering fins. A left turn is initiated by using the steering foot to rotate the steering fins such that the inner ends 402 of the steering fins rotate toward the right edge 403 of the board while the outer ends 404 of the steering fins are rotated toward the left edge of the board. A right turn is initiated by using the steering foot to rotate the inner ends 402 of the steering fins toward the left edge 406 of the board while the outer ends 404 of the steering fins are rotated toward the right edge 403 of the board. Thus, the snowboard 100 turns to the side to which the rider's active/steering foot rotates.

Figure 5:
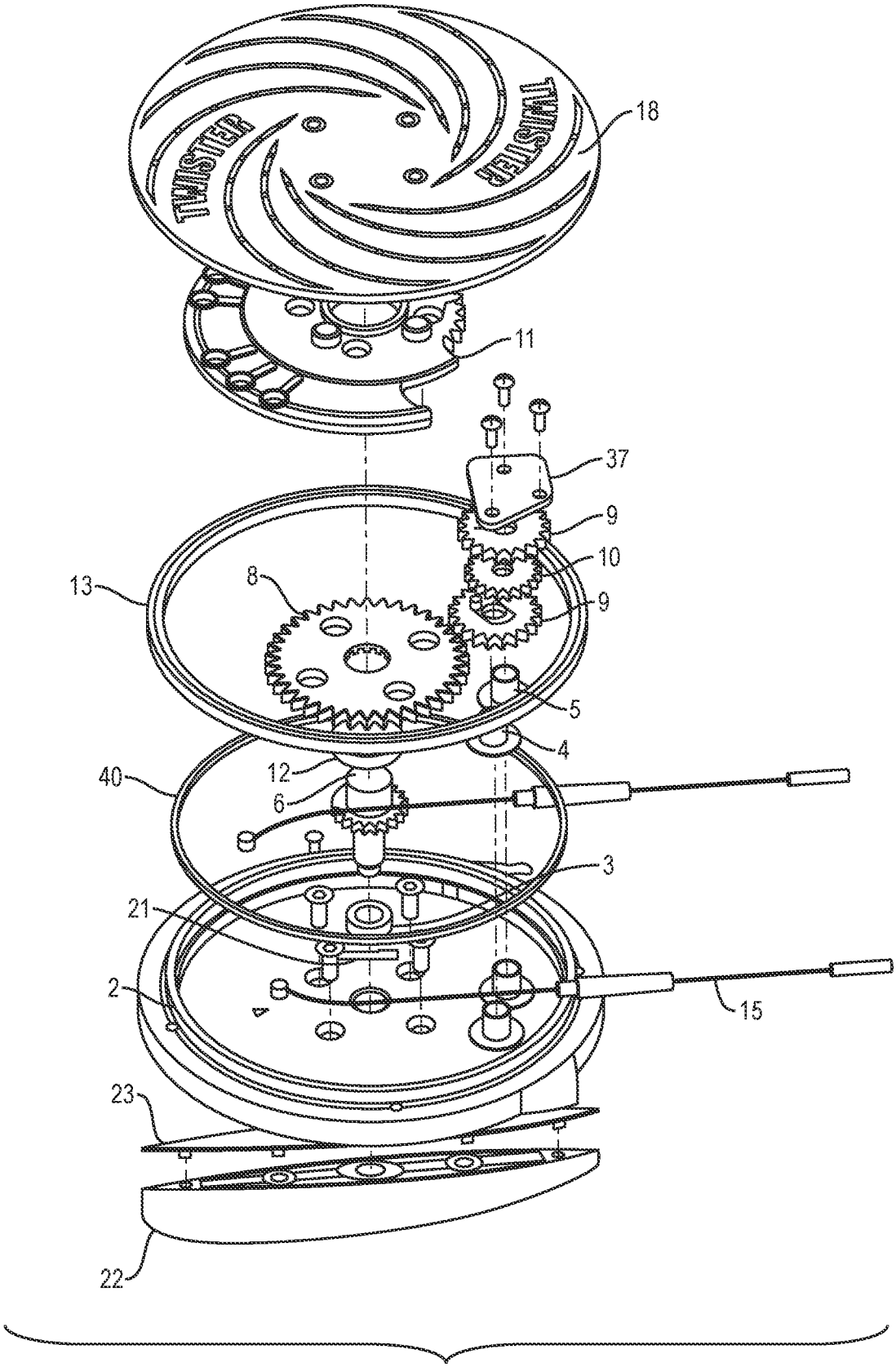
FIG. 5 is an exploded view of the rear active binding interface pod.
Figure 7A:
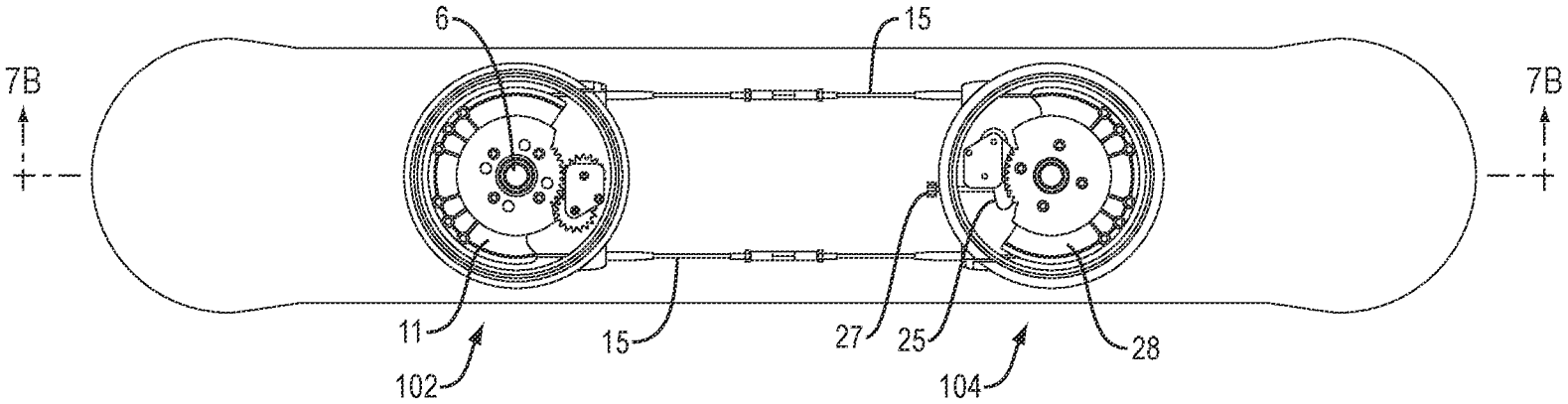
FIG. 7A illustrates the counter-rotating fin steering system of FIGS. 2A-2D without the top plate so that the binding interface pods can be seen in greater detail.
Figure 7B:
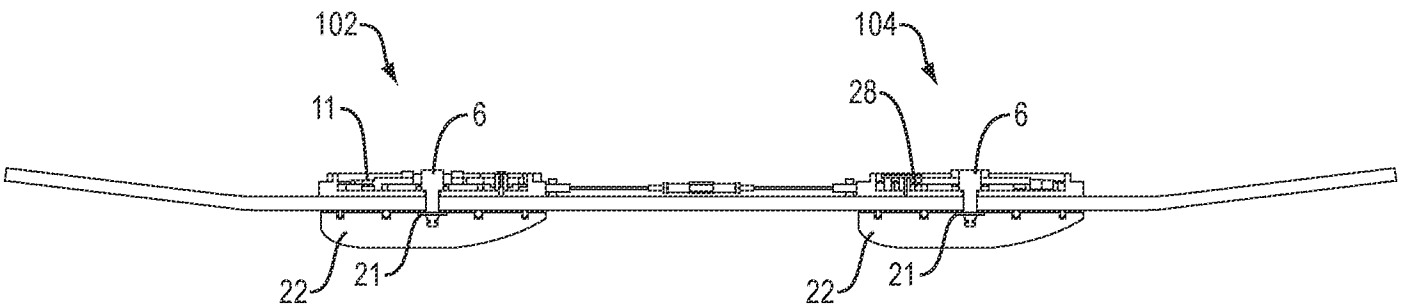
FIG. 7B is a sectional view of FIG. 7A taken along section A-A.

Referring to FIGS. 5, 7A, and 7B, the active (rear) binding interface pod 102 top plate 18 is mounted to a pulley gear (aka middle plate) 11 and a main gear 8 via machine screws and threaded inserts 19. The steering fin 22 is connected to a geared shaft 6, e.g. partially inserted into a bearing 3 fitted into a hole in the steering fin. A transverse shear pin 21 secures the steering fin to the geared shaft. The sheer pin is selected with a break strength that helps to protect the rider from injury due to force translated from the steering fin to the rider's foot. The steering fin includes a thin PTFE wiper 23 that fits against the bottom of the board to facilitate steering fin rotation by reducing friction between the steering fin and board. The geared shaft 6 fits through a hole in the board and a corresponding hole in the base plate 2 which is bolted to top of the board. The bearing 3 is disposed between a larger diameter section of the geared shaft and the base plate to facilitate rotation of the geared shaft, i.e. reducing friction between the geared shaft and base plate. A bearing 12 is located between the geared shaft and the pulley gear. A bearing 13 is positioned between the top plate and the base plate to facilitate rotation of the top plate, i.e. reducing friction between the top plate and the base plate. Main gear 8 drives the geared shaft 6 via a transmission gear stack that includes transmission gears 9 and 10, which are mounted to the base plate 2 via bushings 4, 5 and a retaining plate 37. The ends of the cables 15 are connected to the pulley gear 11 at anchor points. The cables are guided by an arcuate slotted edge of the pulley gear. Transmission gears 9 and 10 rotationally link the pulley gear 11 to the geared shaft 6 such that the geared shaft rotates in the opposite direction relative to the pulley gear. The cables 15 are alternately pulled as a function of the direction of rotation of the pulley gear 11. A flexible nylon retainer line 40 connects the top plate to the base plate.

Figure 6:
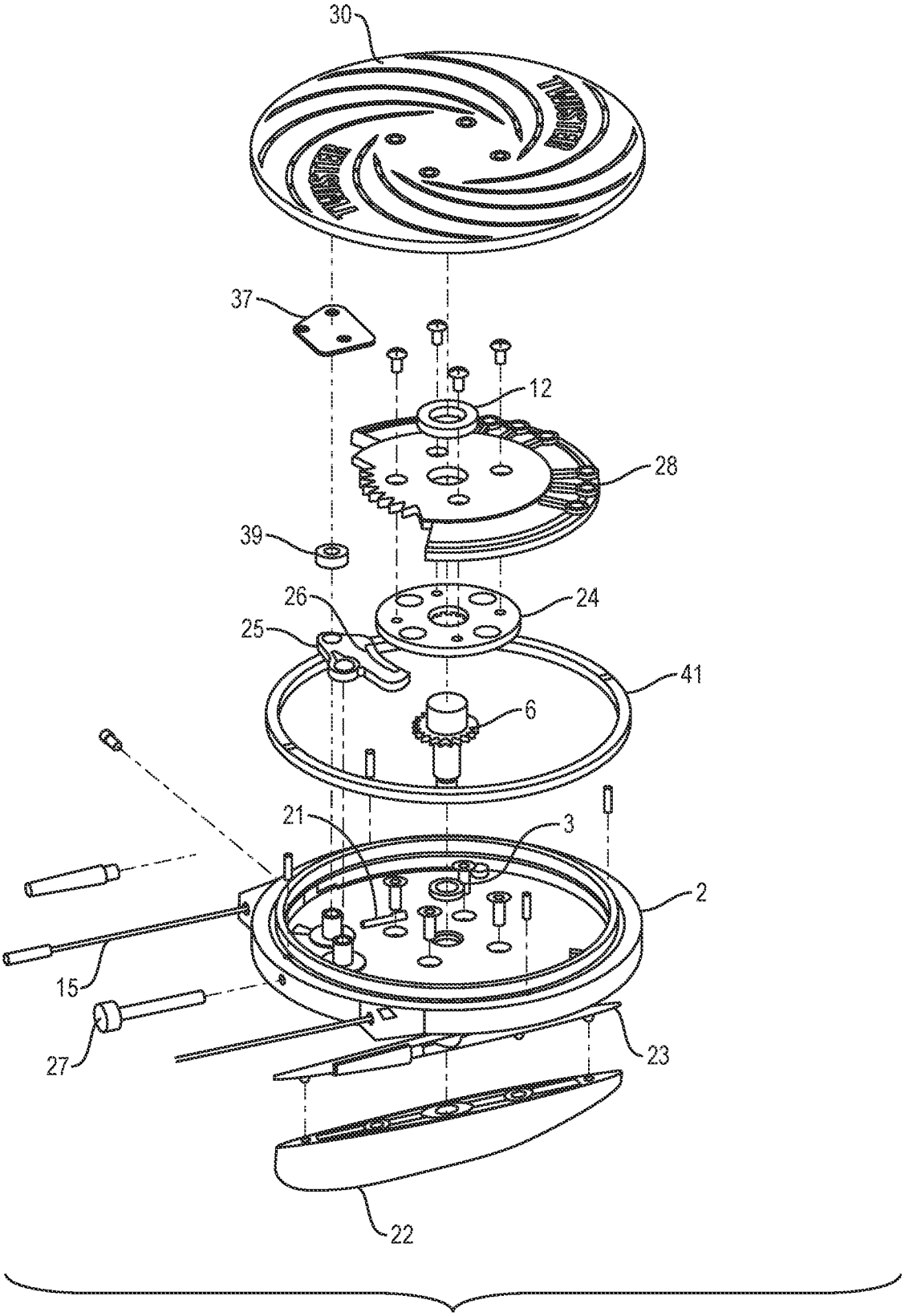
FIG. 6 is an exploded view of the front passive binding interface pod.

Referring to FIGS. 6, 7A, and 7B, the passive (front) binding pod 104 top plate 30 is mounted to base plate 2. A bearing 12 is disposed between the pulley gear (aka middle plate) 28 and the top plate 30. The pulley gear 28 is secured to a brake disk 24 and shaft 6. The shaft 6 fits through a hole in the center of the base plate 2 and connects to the steering fin 22 by a transverse shear pin 21. The steering fin 22 includes a PTFE wiper 23 that fits against the bottom of the board to facilitate steering fin rotation. The ends of the cables 15 are connected to anchor points of the pulley gear 28 and the cables are guides by an arcuate slotted edge of the pulley gear. Force exerted on the cables by the pulley gear of the active binding interface pod causes the pulley gear 28 of the passive binding interface pod to rotate. Rotation of the pulley gear 28 causes rotation of the shaft 6, and thus rotation of the steering fin 22. A threaded brake screw 27 that fits through a threaded opening in the base plate 2 moves a pivoting brake lever 25 to adjust anti-rotational brake force exerted between the brake disk 24 and brake pad 26. The brake lever is secured by a retaining plate 37 and bushing 39. The brake screw can be used to set anti-rotational friction and secure the brake disk and thus the steering fins in a fixed orientation such that they do not rotate. A flexible nylon retainer line 41 connects the top plate to the base plate.

Figure 8A:
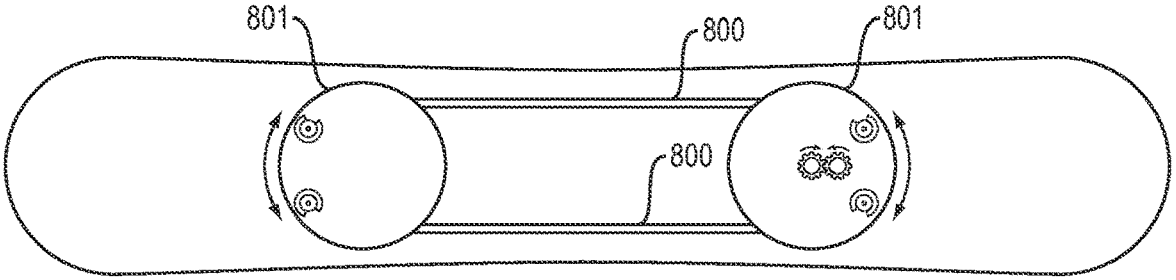
FIGS. 8A, 8B, 8C, and 8D illustrate linkages between binding pods for coordinating counter-rotation of the steering fins.
Figure 8B:
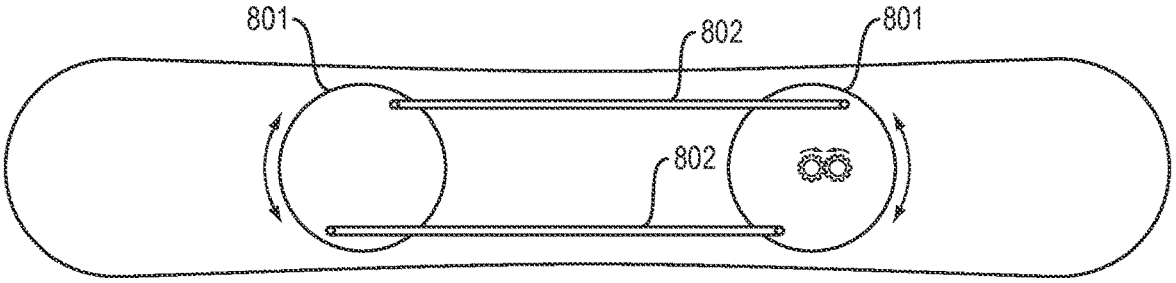
Figure 8C:
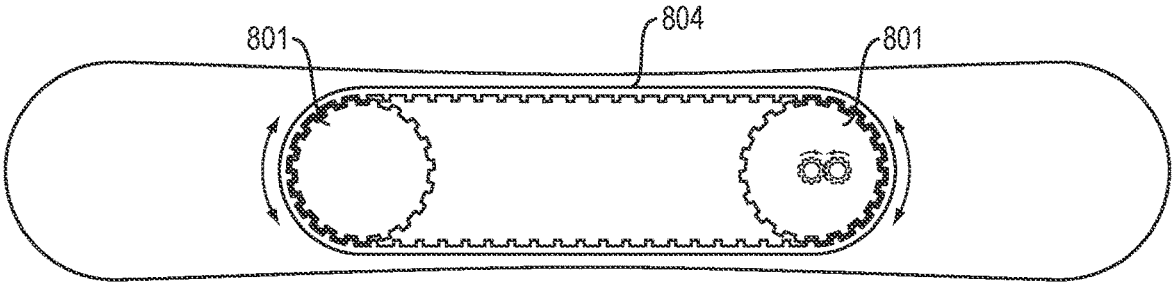
Figure 8D:
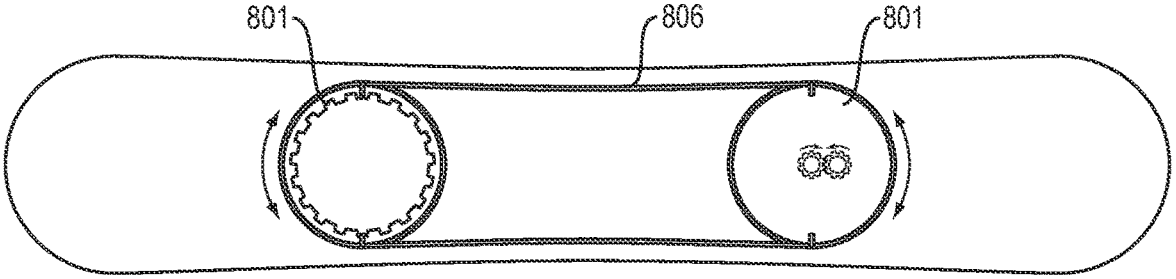

FIGS. 8A, 8B, 8C, and 8D illustrate examples of linkages between rotational translators for coordinating counter-rotation of the steering fins. FIG. 8A illustrates a linkage including two flexible cables 800. The cables could include braided or parallel wires or filaments. Each end of each of the cables is actively anchored to one of a circular middle plate pulley 801. The cables are partially wound around circular or arcuate slots the middle plate pulleys in opposite directions relative to a center. Consequently, the middle plate pulleys 801 can only rotate in the same direction in a coordinated manner. Counter-rotation of the center shaft is induced by gears that link the active side middle plate to the active side center shaft. FIG. 8B illustrates a linkage using two inflexible rods 802. Each end of each of the rods is actively anchored to one of the circular middle plate pulleys 801. The rods are free to pivot relative to the middle plate pulleys at anchor points. A center of rotational movement of the middle plate is between the anchor points so the middle plate pulleys can only rotate in a coordinated manner in the same direction with the rods exerting push and pull forces. FIG. 8C illustrates a linkage using a belt 804. The belt wraps around the circular middle plate pulleys 801. Specifically, teeth disposed around each middle plate engage teeth on the inner side of the belt 804. The middle plate pulleys therefore only rotate in a coordinated manner in the same direction. FIG. 8D illustrates a linkage using a chain 806. The chain wraps around the circular middle plate pulleys 801. Specifically, sprocket teeth disposed around each middle plate engage the chain. The middle plate pulleys therefore only rotate in a coordinated manner in the same direction.

Figure 9:
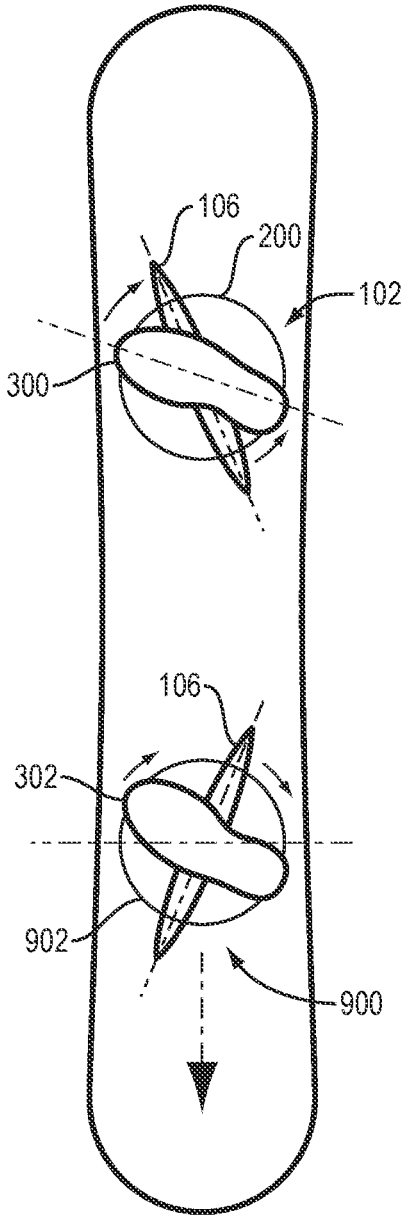
FIG. 9 illustrates the relationship between rotation of the rider's feet and rotation of the steering fins in an implementation with two active binding interface pods.

FIG. 9 illustrates an implementation configured for double-footed steering. In this implementation both binding interface pods 102, 900 are active, e.g. both top plates rotate and are rotationally linked to the corresponding middle plate pulleys. Rotational movement of the rider's right foot 300 causes the right top plate of binding interface pod 102 to rotate, which causes the associated steering fin to counter-rotate relative to the rider's feet. Rotational movement of the rider's left foot 302 causes the left top plate 902 of binding interface pod 900 to rotate, which causes the associated steering fin 106 to rotate in the same direction as the rider's feet. The linkage between the binding interface pods 102, 900 coordinates rotation of the steering fins. For example, the linkage assures that the steering fins exhibit the same degree of rotational movement relative to the 0 degrees position, albeit in opposite directions of rotation. It should be noted that the double-footed steering implementation could be reversed such that the right-foot steering fin rotates in the same direction as the rider's right foot and the left-foot steering fin counter-rotates relative to the rider's left foot.

Figure 10:
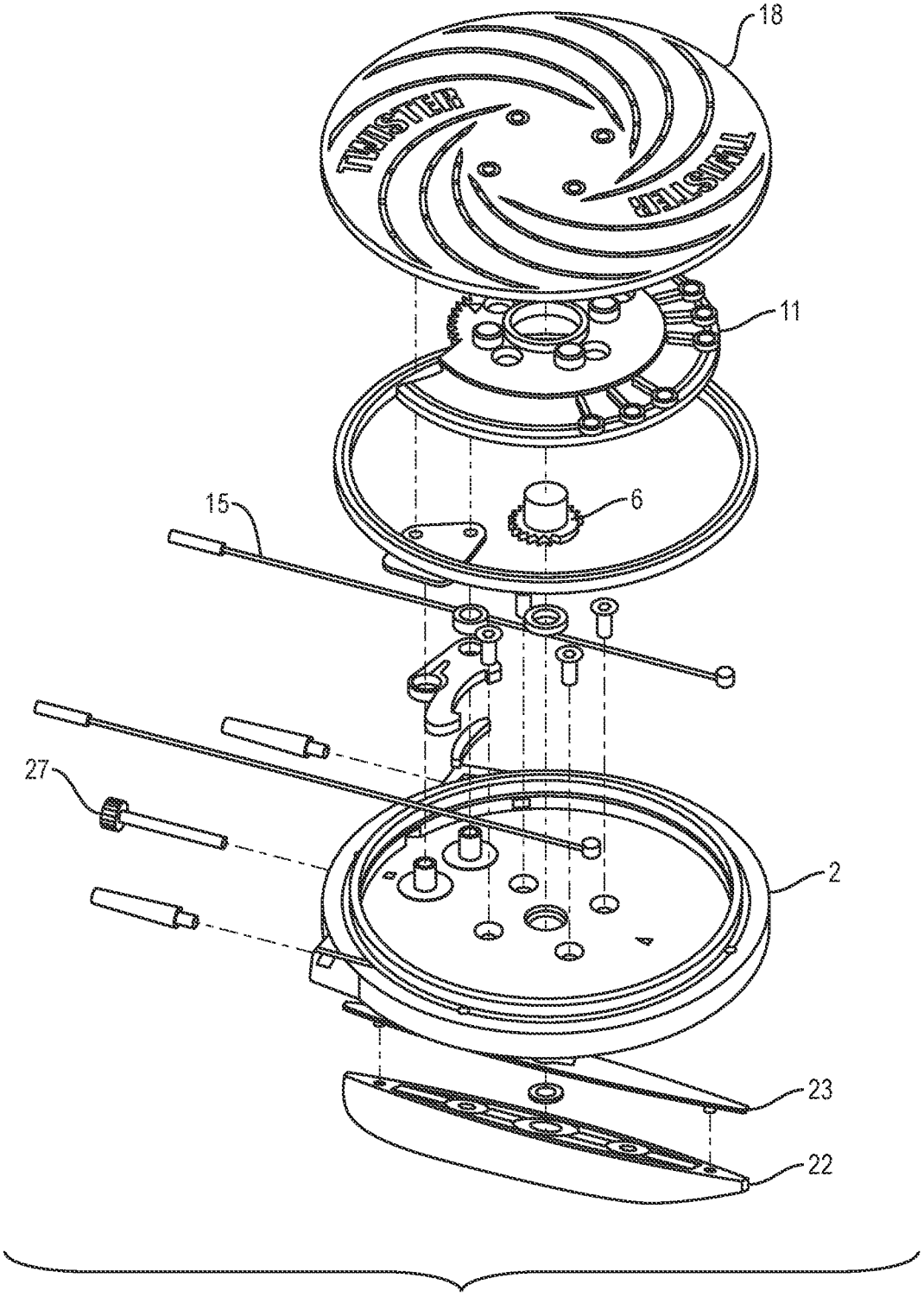
FIG. 10 is an exploded view of a front active binding interface pod.

FIG. 10 is an exploded view of the front active binding interface pod 900 (FIG. 9). The active (front) binding interface pod top plate 18 is mounted to the pulley gear (aka middle plate) 11. The pulley gear 11 is secured to a brake disk 24 and shaft 6. The shaft 6 fits through a hole in the base plate 2 and connects to the steering fin 22. Steering fin 22 is connected to the shaft 6 via a hole and transverse shear pin 21. The steering fin includes a PTFE wiper 23 that fits against the bottom of the board to facilitate steering fin rotation. Cables 15 are connected to the pulley gear 11 via anchor points and an arcuate slotted edge. Rotational force exerted on the pulley gear 11 via rotation of top plate 18 causes rotation of the shaft 6. Force exerted on the cables 15 by the pulley gears of the pulley gears of both active binding interface pods causes the pulley gears to rotate in a coordinated manner, e.g. in the same direction and degree of rotation. Rotation of the pulley gear 11 causes rotation of the shaft 6, and thus rotation of the steering fin. A threaded brake screw 27 that fits through a threaded opening in the base plate moves a pivoting brake lever to adjust anti-rotational brake force exerted against the brake disk. The brake screw can be used to set anti-rotational friction and secure the steering fins in a fixed orientation such that they do not rotate. Unlike the active (rear) binding pod 102 (FIG. 5), the active (front) binding interface pod steering fin 22 rotates in the same direction as the top plate 18.

Figure 11:
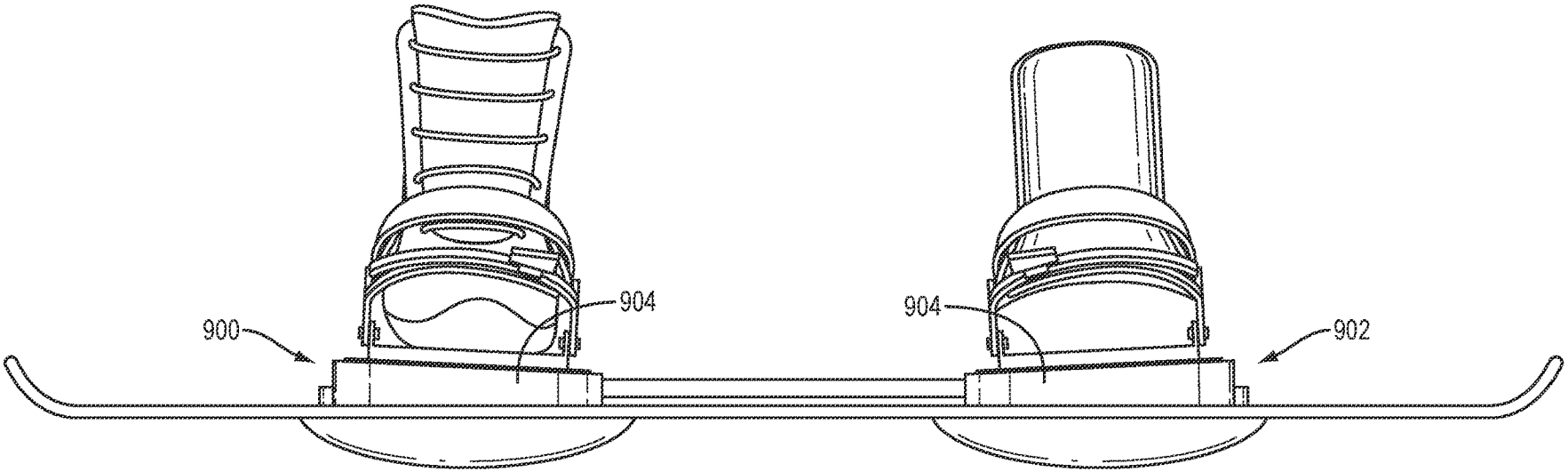
FIG. 11 illustrates a snowboard with a counter-rotating fin steering system that includes inward-canted interface pods.
Figure 12A:
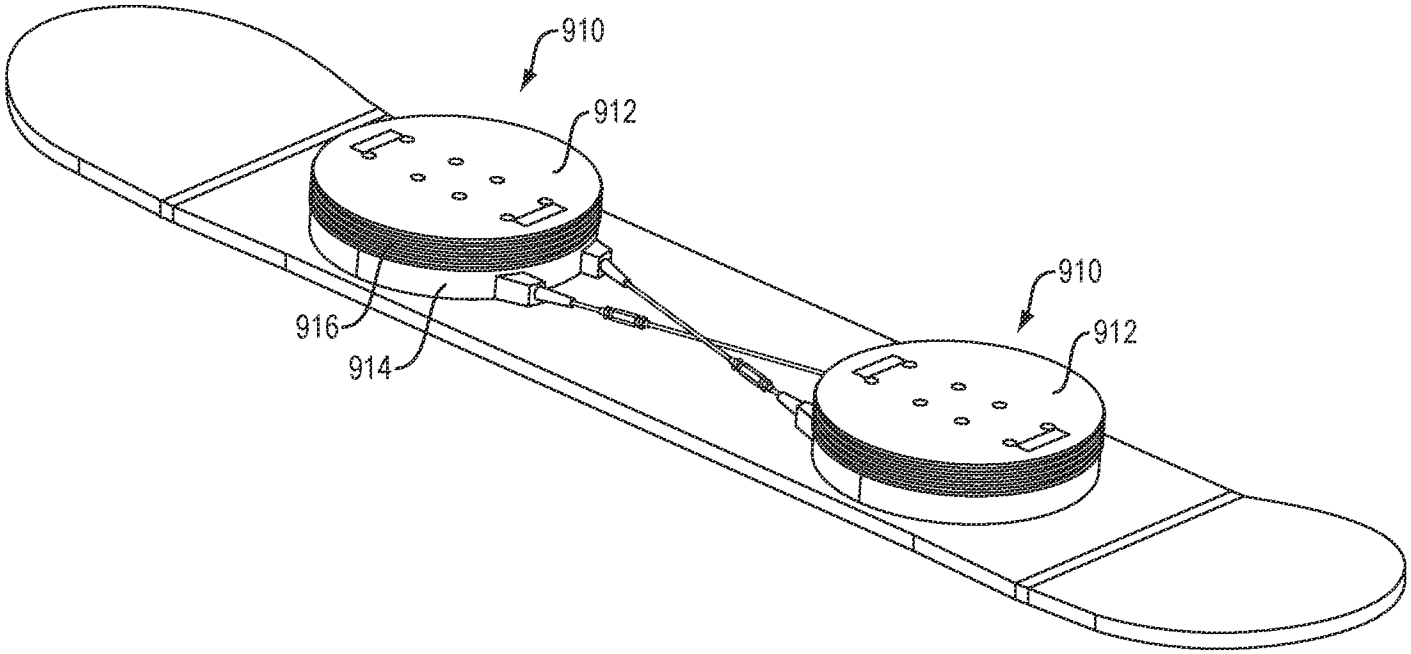
FIGS. 12A, 12B, 12C, and 12D illustrate a snowboard with a counter-rotating fin steering system responsive to pivoting of the rider's feet in planes that are orthogonal to the axes of rotation of the steering fins.
Figure 12D:
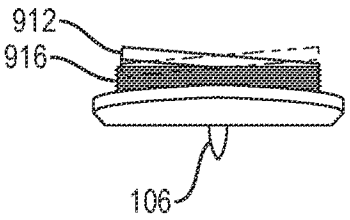
Figure 12B:
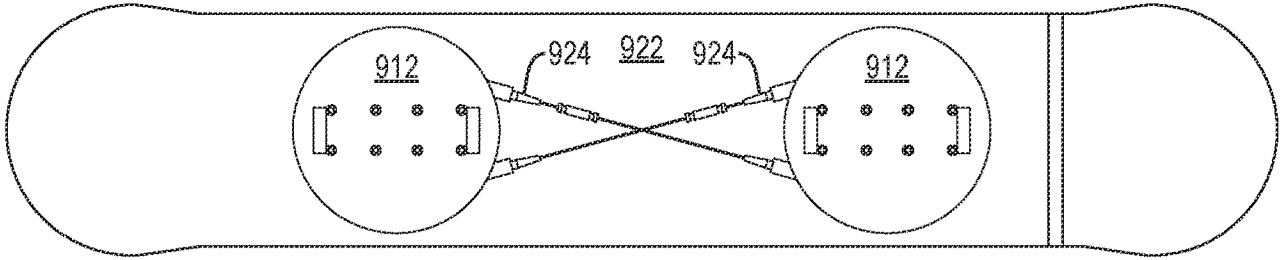
Figure 12C:
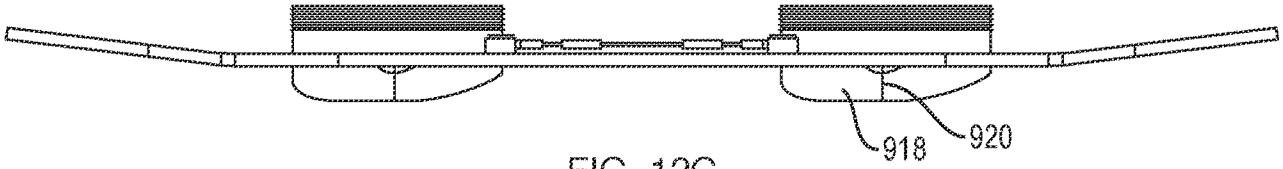

FIG. 11 illustrates a snowboard with a counter-rotating fin steering system that includes inward-canted interface pods 900, 902. The inward-canted interface pods have base plates 904 featuring non-parallel circular ends. More particularly, the bottom end that is secured against the snowboard is non-parallel with the top end on which the top plate is mounted, e.g. offset by from 10-20 degrees, inclusive. The height dimension of the base plates is smallest at the closest points between the inward-canted interface pods 900, 902 and greatest at the most distant points between the inward-canted interface pods. Consequently, the left and right top plates, bindings, and rider's feet are canted inward toward each other. A joint between the top plates and shaft and/or pulleys translates rotation of the top plate in a first plane/axis into rotation of the pulley/shaft in a second plane/axis. Apart from the joint and base plates the parts of the inward-canted interface pods are substantially the same as the non-canted interface pods described above. The inward-canted interface pods help to avoid strain on the rider's ankles and hips.

FIGS. 12A, 12B, 12C, and 12D illustrate a snowboard with a counter-rotating fin steering system responsive to pivoting of the rider's feet in planes that are orthogonal to the axes of rotation of the steering fins. Each binding interface pod 910 includes a top plate 912, base plate 914, bellows 916, and a steering fin 918 connected to a shaft 920. The base plate is secured to the snowboard 922 and does not move with respect to the snowboard. The top plate 912 has a circular upper surface that is normally parallel with the top of the snowboard 922 and does not rotate with respect to the base plate. However, the top plate pivots in response to force applied by the rider's foot such that the upper surface is non-parallel with respect to the top of the snowboard. Specifically, the rider's foot can pivot forward or backward relative to the rider, thereby causing the upper surface of the top plate to pivot side-to-side relative to the snowboard and out of parallel with the top surface of the snowboard in either of two directions as specifically shown in FIG. 12D. Tilting to +/−8 degrees from parallel with the top surface of the snowboard may translate to +/−30 degrees for rotation of the steering fins. The bellows 916 is connected at a gap between the base plate 914 and the top plate 912 to help prevent snow from entering the binding interface pod while allowing pivoting of the top plate. The steering fin rotates in response to the side-to-side pivoting of the top plate. Specifically, the direction of pivot of the top plate determines the direction of rotation of the steering fin. In some implementations the steering fins cause the snowboard to turn to the side on which the top plates are pivoted downward, thereby training the rider to lean into the turn. Two cables 924 provide a cross-cable linkage between the binding interface pods that coordinates counter-rotation of the steering fins. Both binding interface pods may be active and substantially identical although oriented with a 180-degree offset when mounted on the snowboard. It should be noted that the cross-cable linkage could be used with any of the binding interface pod implementations described above, e.g. based on rotation of the top plate.

Figure 13:
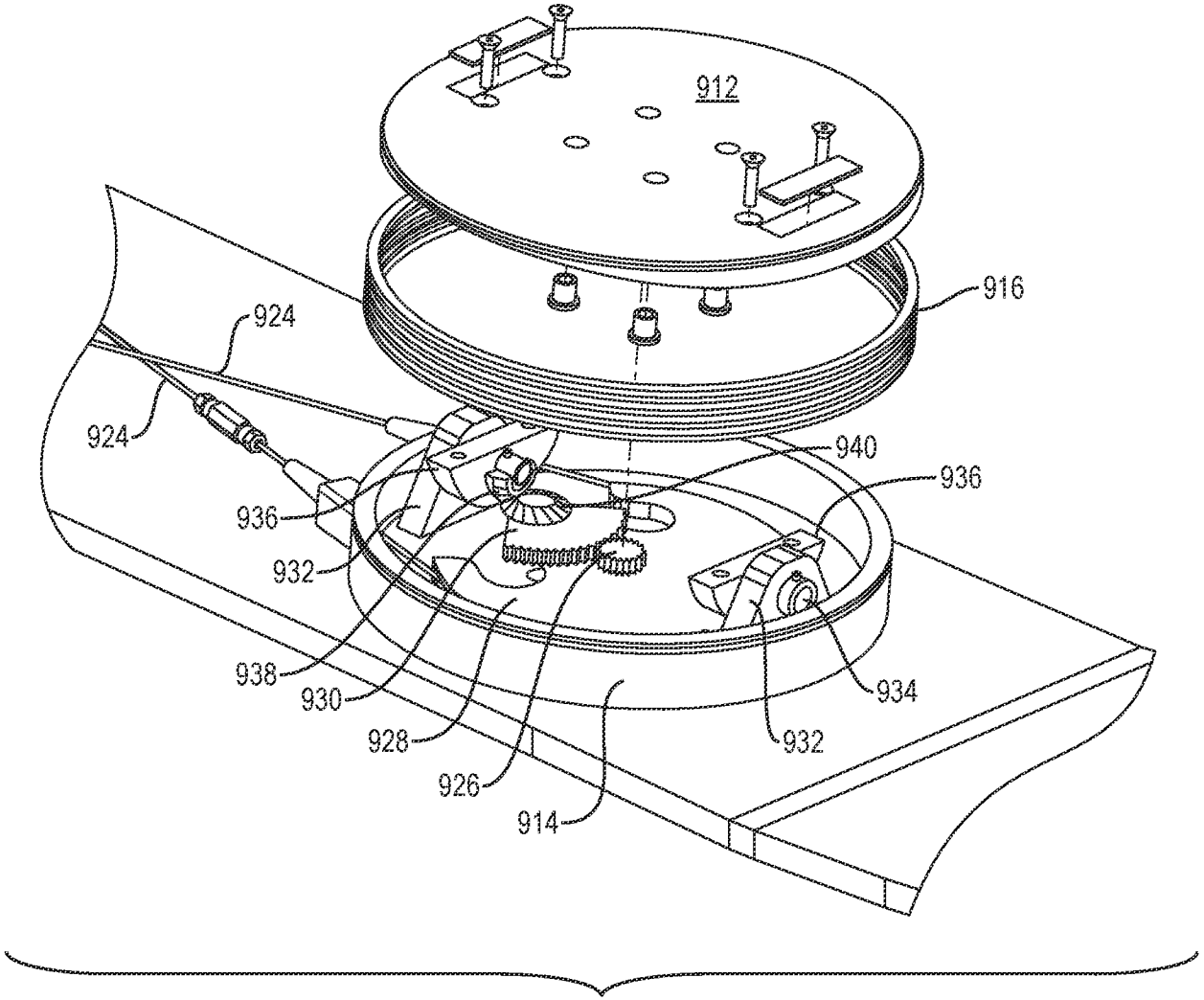
FIG. 13 illustrates one of the binding pods of FIGS. 12A through 12D in greater detail.
Figure 14:
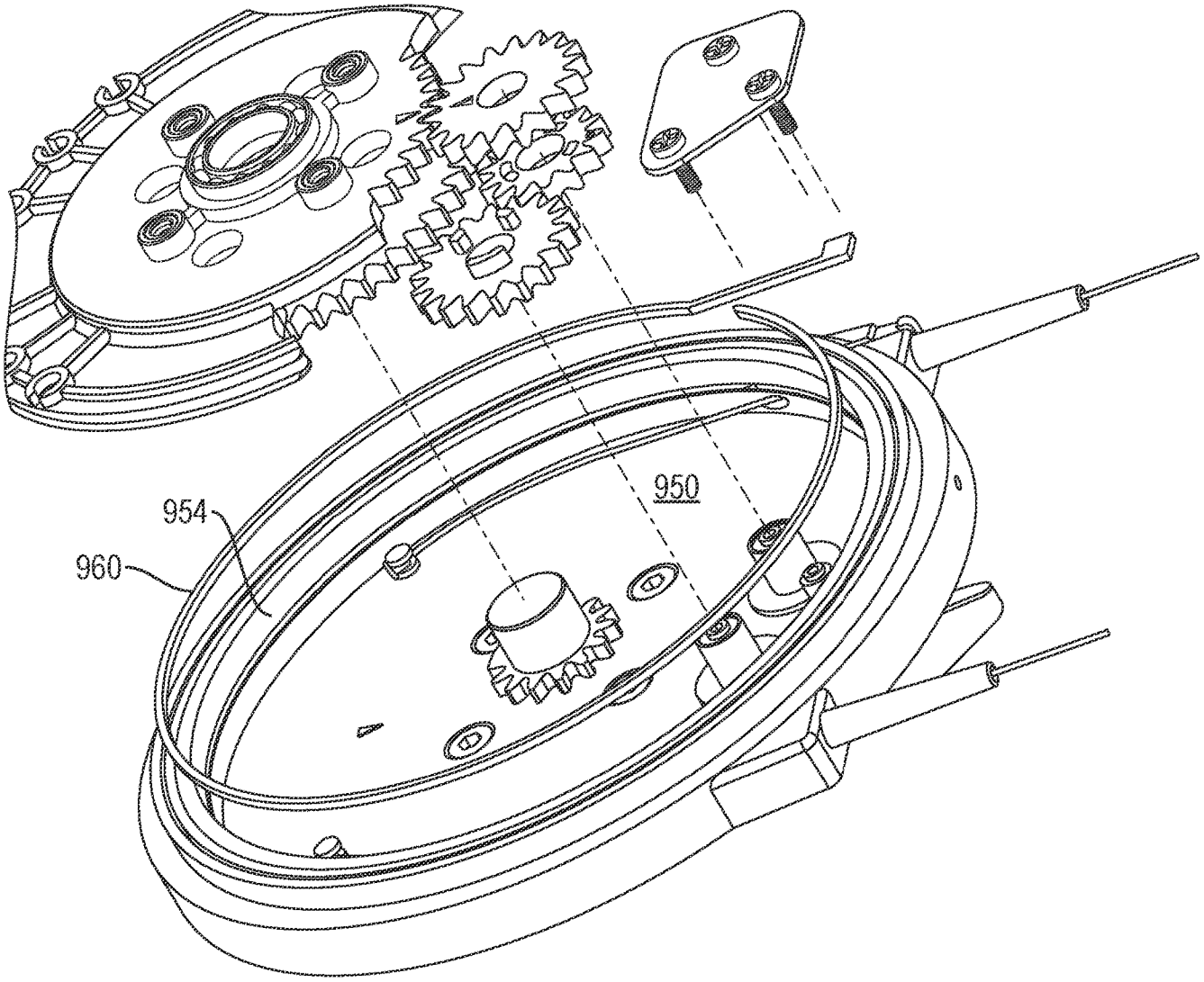
FIGS. 14, 15A, 15B, and 16 illustrate the retainer line in greater detail.
Figure 15A:
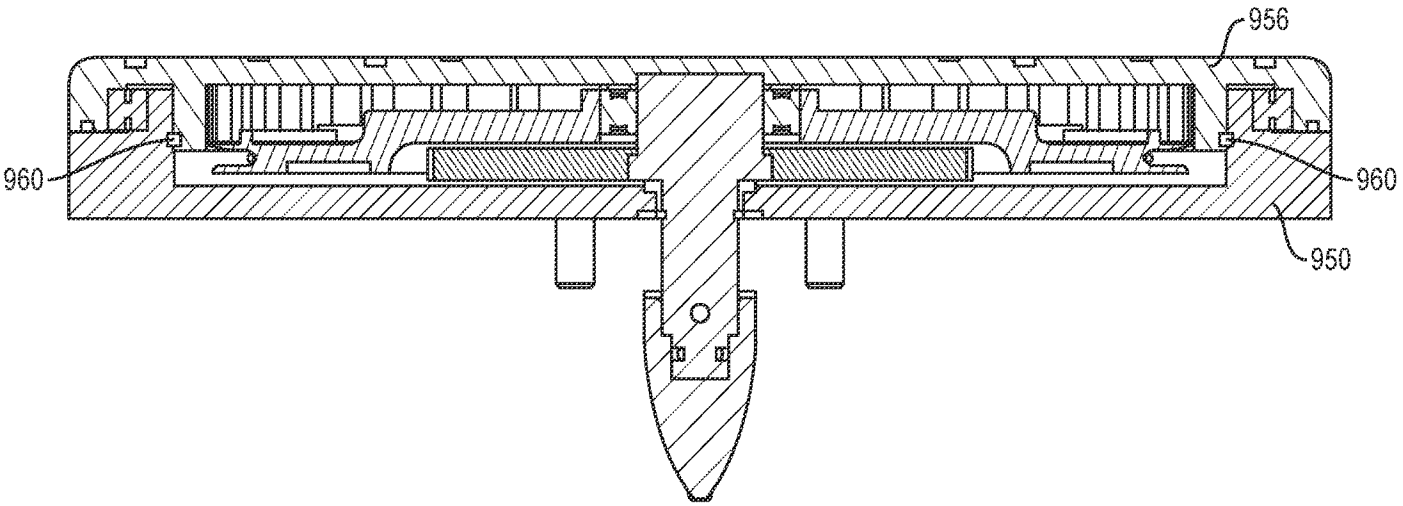
Figure 15B:
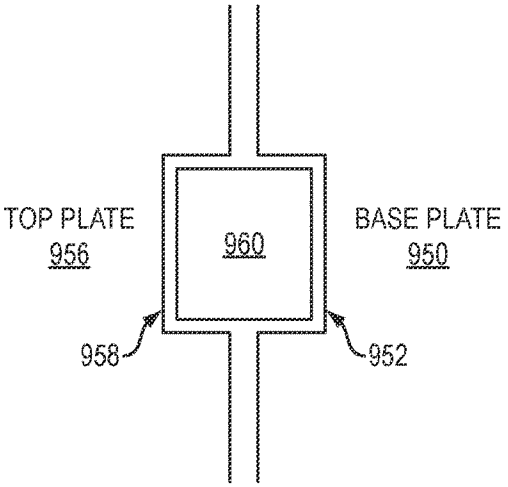
Figure 16:
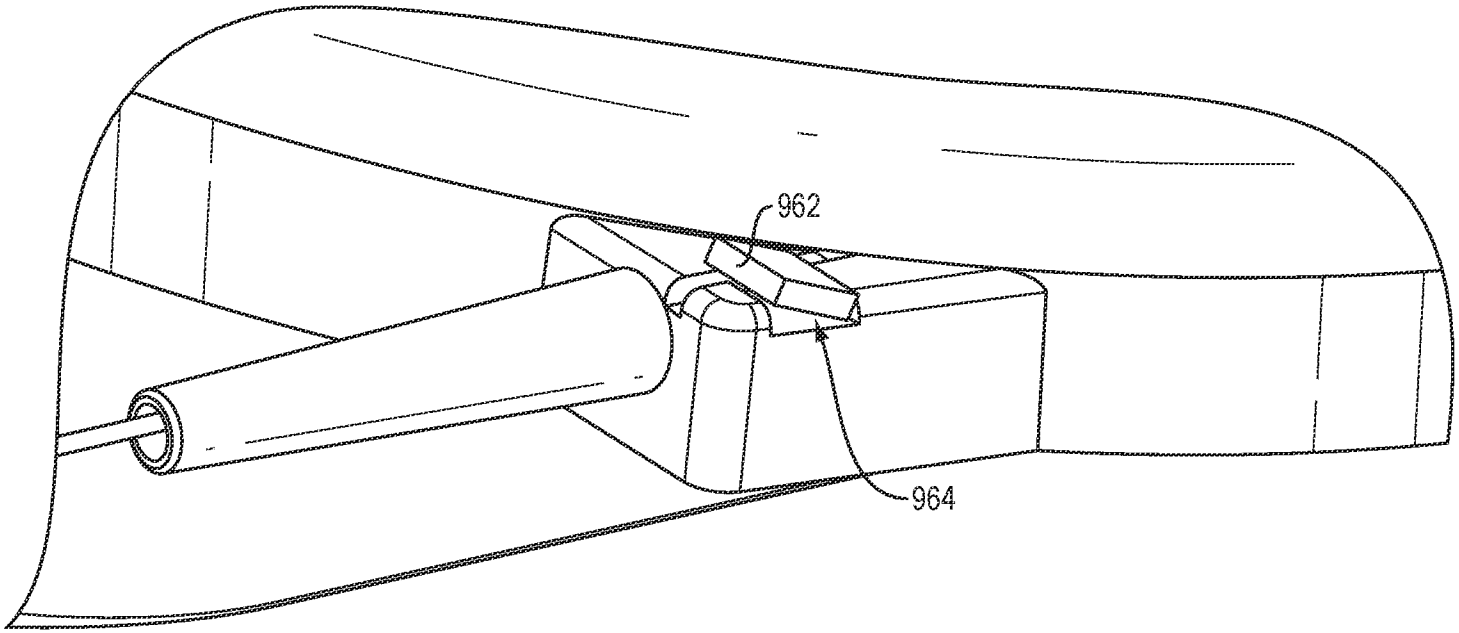
Figure 17:
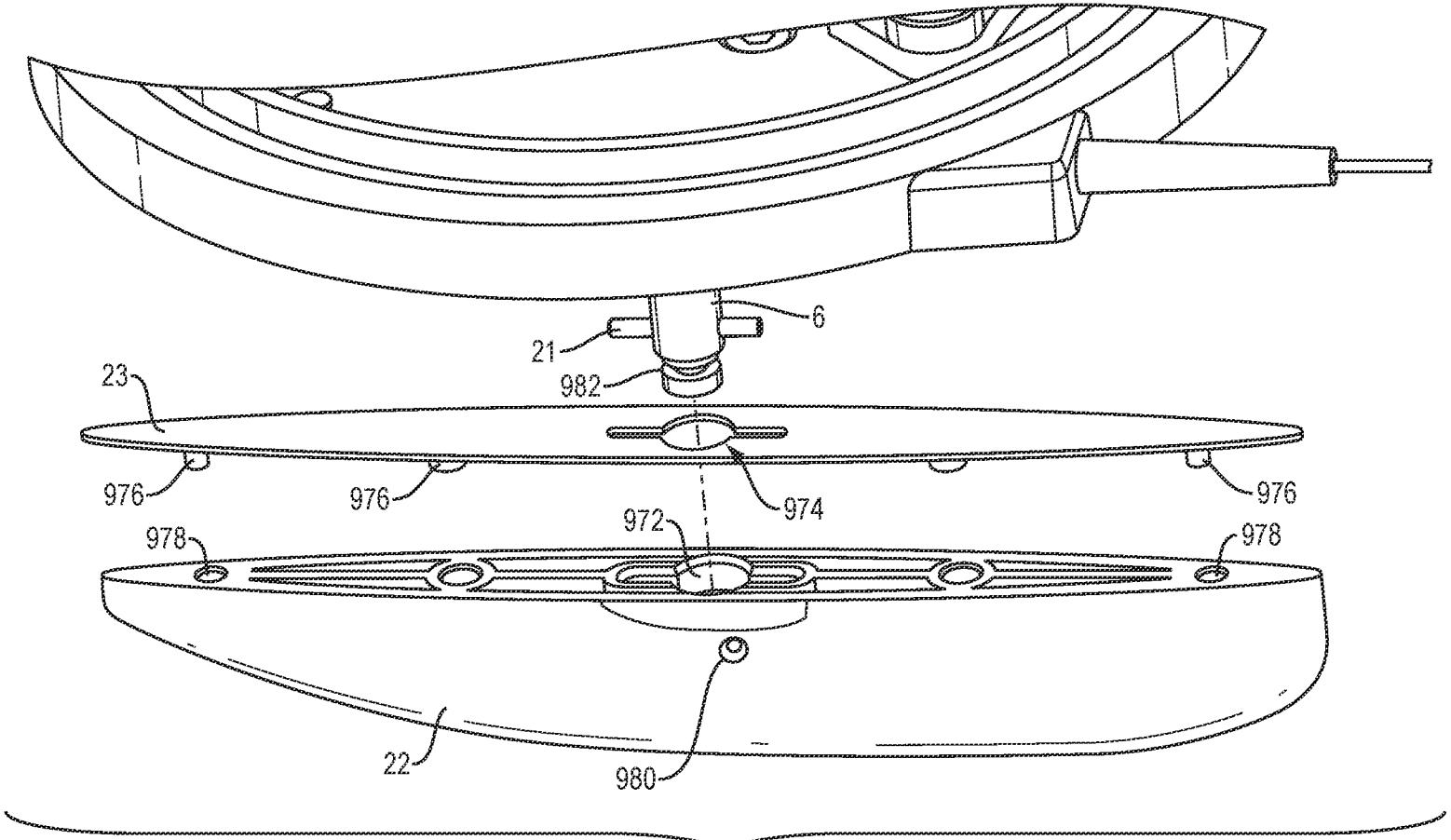
FIGS. 17, 18, 19A and 19B illustrate connection between the geared shaft and steering fin in greater detail.
Figure 18:
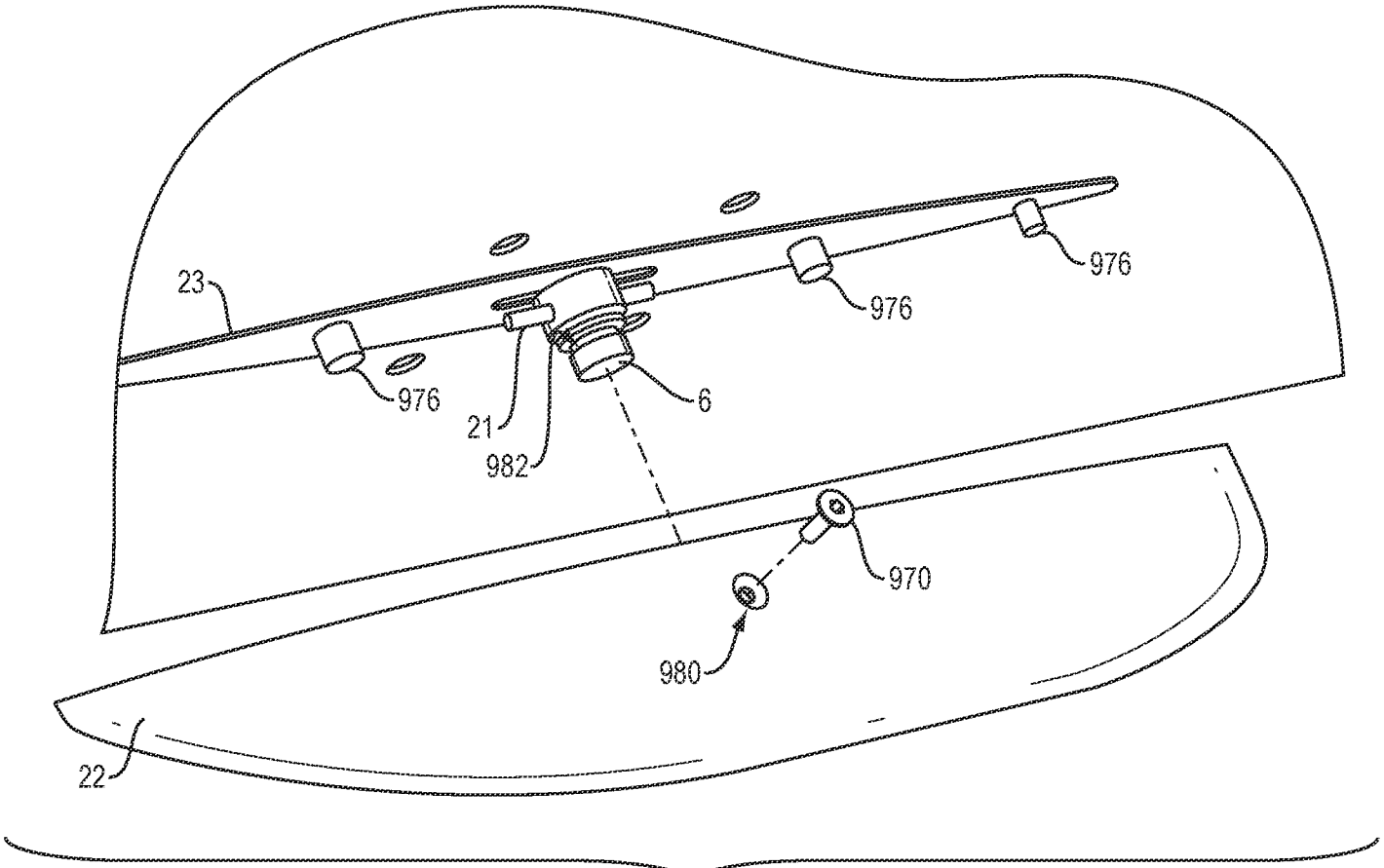
Figure 19A:
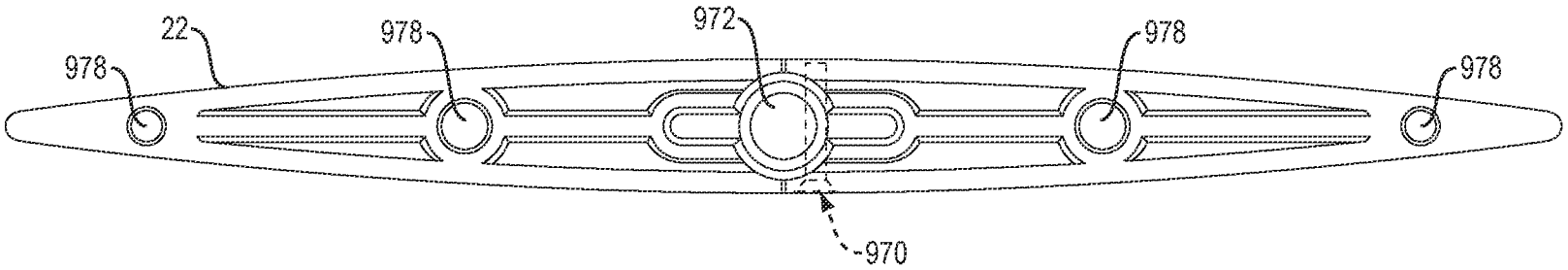
Figure 19B:
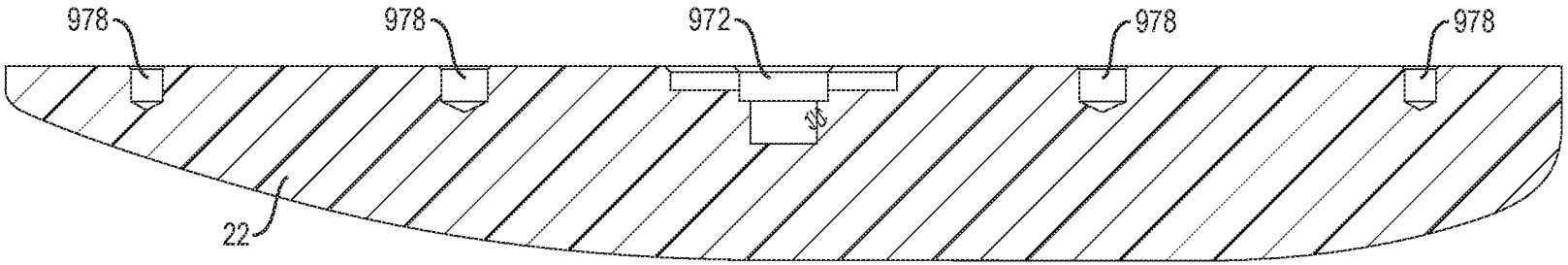

FIG. 13 illustrates one of the binding pods of FIGS. 12A through 12D in greater detail. The shaft 920 (FIG. 12C) links the steering fin to a center gear 926 and pulley 928. The gears of a geared quadrant 930 are operationally linked to (meshed with) the center gear. Two vertical supports 932 are disposed inside the base plate 914, i.e. in fixed positions relative to the base plate. Rotating axles 934 link the vertical supports 932 to mounts 936 such that the mounts are rotatable via the axles. The top plate 912 is bolted to the mounts 936. One of the axles has a bevel gear 938 disposed at a distal end. The geared quadrant 930 includes a bevel gear 940 that is operationally linked to (meshed with) the axle bevel gear 938. Pivoting of the top plate 912 relative to the base plate causes the mounts 936 to pivot on the axels. Pivoting of the mounts is translated via the axle, bevel gear 938, quadrant bevel gear 940, quadrant 930, and center gear 926 into rotation of the shaft connected to the steering fin. Pivoting of the mounts is also translated into rotation of the pulley 928. Rotation of the pulley of either binding interface pod is translated into counter-rotation of the pulley of the other binding interface pod via the cables 924. Consequently, the steering fins counter-rotate with the same magnitude of angular offset but in opposite directions.

FIGS. 14, 15A, 15B, and 16 illustrate the retainer line that connects the top plate to the base plate in greater detail. Each base plate 950 includes a circular recess/notch 952 formed in the inner sidewall 954. Each top plate 956 includes a corresponding circular recess/notch 958 formed in a sidewall. The recesses are rectangular in cross section. During assembly the circular recesses are aligned and the retainer line 960 is inserted into the opening formed by the aligned recesses. The retainer line 950 may be made from a flexible nylon and has a rectangular cross section with similar dimension to the opening formed by the aligned recesses as specifically shown in FIG. 14B. When inserted, the retainer line prevents the top plate from moving vertically up or down relative to the base plate but allows the top plate to rotate relative to the base plate. Side openings in the top plate and base plate may be provided so that a free end of the retainer line is disposed outside of the top and base plates when installed. A handle 962 may be formed on the free end of the retainer line. The handle may snap-fit into a slot 964 in the base plate. The top plate may be released from the base plate by pulling on the handle to remove the handle from the slot and pulling the handle to remove the retainer line from the opening formed by the aligned recesses.

FIGS. 17, 18, 19A and 19B illustrate connection of the steering fin to the geared shaft in greater detail. The shear pin 21, which is longer than the diameter of the geared shaft, is situated in a transverse hole through the geared shaft 7 such that the primary axis of the shear pin is orthogonal to the primary axis of the geared shaft. Distal ends of the shear pin extend from the transverse hole. The geared shaft and shear pin are inserted into a slotted opening 972 in the top of the steering fin 22. More specifically, the sheared shaft fits into a cylindrical hole of the slotted opening and the shear pin fits into a slot of the slotted opening. The shear pin establishes a rotational connection between the geared shaft and the steering fin. Rotation of the geared shaft 6 causes the shear pin to rotate, which in turn applies force against the steering fin, thereby causing the steering fin to rotate. Application of excessive force between the steering fin and the geared shaft via the shear pin results in breakage of the shear pin, thereby rotationally decoupling the shaft from the steering fin. The break strength of the shear pin is selected such that the rider is protected from injury due to excessive feedback force applied to the geared shaft by the steering fin.

The wiper 23 includes a slotted opening 974 through which the geared shaft 6 and shear pin 21 pass when being inserted into the steering fin. Four projections 976 formed on the bottom of the wiper 23 fit into corresponding openings 978 in the top of the steering fin 22. More specifically, the projections are press fitted into the openings and maintain alignment between the wiper and the steering fin.

The steering fin 22 is secured to the geared shaft 6 with a fastener 970 such as a machine screw. The geared shaft 6 includes a slot 982 characterized by a smaller shaft diameter than portions of the shaft above and below the slot. Slot 982 depth and width may be approximately the same as the diameter of the shaft of the fastener 970. The fastener is inserted into a countersunk offset opening 980 in one side of the steering fin 22. The wall of the steering fin on the opposite side includes a threaded hole that is engaged by the threads of the fastener. The opening 980 is offset relative to the center of the slotted opening 972 such that the shaft of the fastener fits into and traverses the slot 982 of the geared shaft. Thus, the fastener secures the steering fin to the geared shaft without inhibiting free rotation of the steering fin relative to the geared shaft when the shear pin breaks under excessive force. The shear pin can be replaced by removing the fastener 970 such that the steering fin can be removed from the shaft 6, thereby exposing the shear pin 21. After inserting a new shear pin into the shaft, the steering fin is fitted back onto the geared shaft and secured thereto with the fastener.

A number of features, aspects, embodiments and implementations have been described. Nevertheless, it will be understood that a wide variety of modifications and combinations may be made without departing from the scope of the inventive concepts described herein. Accordingly, those modifications and combinations are within the scope of the following claims.

What is claimed is:

1. An apparatus for turning a sport board in response to foot dorsiflexion and plantarflexion, comprising:

a first binding interface pod configured to be mounted on a longitudinal centerline of the board proximate to a first distal end, the first binding interface pod comprising a first axis pivotable first top plate configured to be positioned above a top of the board and a second axis rotatable first steering fin configured to extend from a bottom of the board, wherein the first axis is orthogonal to the second axis, the pivotable first top plate mechanically linked to the first steering fin such that the first steering fin counter-rotates in response to pivoting of the first top plate and rotates in response to counter-pivoting of the first top plate;

a second binding interface pod configured to be mounted on the longitudinal centerline of the board in alignment with the first binding interface pod and proximate to a second distal end, the second binding interface pod comprising a stationary second top plate configured to be positioned above a top of the board and a rotatable second steering fin configured to extend from the bottom of the board; and a linkage that connects the first top plate with the second steering fin such that the second steering fin rotates responsive to pivoting of the first top plate and counter-rotates responsive to counter-pivoting of the first top plate, whereby alternating pivoting and counter-pivoting of the pivotable first top plate with dorsiflexion and plantarflexion of a first foot of a rider causes the sport board to be steered in S-shaped turns while a second foot of the rider remains stationary relative to the stationary second top plate and thereby facilitates maintenance of balance of the rider on the board during steering.

2. The apparatus of claim 1 wherein n degrees of pivot of the first top plate causes counter-rotation of −n degrees of the first steering fin.

3. The apparatus of claim 2 wherein n degrees of pivot of the first top plate causes rotation of n degrees of the second steering fin.

4. The apparatus of claim 1 wherein n degrees of pivot of the first top plate causes counter-rotation of −m degrees of the first steering fin.

5. The apparatus of claim 4 wherein n degrees of pivot of the first top plate causes rotation of m degrees of the second steering fin.

6. The apparatus of claim 1 wherein the first binding interface pod comprises a first pulley, the second binding interface pod comprises a second pulley, and the linkage comprises first and second cables that each connect to the first and second pulleys.

7. The apparatus of claim 1 wherein the first binding interface pod comprises a first pulley, the second binding interface pod comprises a second pulley, and the linkage comprises first and second rods that each connect to the first and second pulleys.

8. The apparatus of claim 1 wherein the first binding interface pod comprises a first pulley, the second binding interface pod comprises a second pulley, and the linkage comprises a belt that connects the first and second pulleys.

9. The apparatus of claim 1 wherein the first binding interface pod comprises a first pulley, the second binding interface pod comprises a second pulley, and the linkage comprises a chain that connects the first and second pulleys.

10. The apparatus of claim 1 wherein the first binding interface pod is mounted to a snowboard such that the first top plate is non-parallel with a top surface of the snowboard.

11. A method for turning a sport board in response to foot dorsiflexion and plantarflexion, comprising:

steering the board in response to in response to dorsiflexion and plantarflexion of only one foot of a rider with a first pivotable binding interface pod configured to be mounted on a longitudinal centerline of the board proximate to a first distal end and a second binding interface pod configured to be mounted on the longitudinal centerline of the board in alignment with the first binding interface pod and proximate to a second distal end by:

pivoting a first top plate of the first binding interface pod around a first axis responsive to dorsiflexion of a first foot of the rider and counter-pivoting the first top plate responsive to plantarflexion of the first foot of the rider;

counter-rotating a first steering fin of the first binding interface pod in response to pivoting of the first top plate and rotating the first steering fin in response to counter-pivoting of the first top plate;

rotating a second steering fin of the second binding interface pod in response to pivoting of the first top plate and counter-rotating the second steering fin in response to counter-pivoting of the first top plate; and maintaining a second foot of the rider stationary relative to the board with a stationary second top plate of the second binding interface pod, whereby alternating pivoting and counter-pivoting of the rotatable first top plate with dorsiflexion and plantarflexion of the first foot of the rider causes the sport board to be steered in S-shaped turns while the second foot of the rider remains stationary relative to the stationary second top plate, thereby facilitating maintenance of balance of the rider on the board during steering.

12. The method of claim 11 comprising counter-rotating the first steering fin of the first binding interface pod −n degrees in response to n degrees of pivoting of the first top plate.

13. The method of claim 12 comprising rotating the second steering fin of the second binding interface pod n degrees in response to n degrees of pivoting of the first top plate.

14. The method of claim 11 comprising counter-rotating the first steering fin of the first binding interface pod −m degrees in response to n degrees of pivoting of the first top plate.

15. The method of claim 14 comprising rotating the second steering fin of the second binding interface pod m degrees in response to n degrees of pivoting of the first top plate.

16. The method of claim 11 wherein the first binding pod comprises a first pulley, the second binding interface pod comprises a second pulley, and comprising rotationally linking the first pulley to the second pulley with first and second cables that each connect to the first and second pulleys.

17. The method of claim 11 wherein the first binding interface pod comprises a first pulley, the second binding interface pod comprises a second pulley, and comprising rotationally linking the first pulley to the second pulley with first and second rods that each connect to the first and second pulleys.

18. The method of claim 11 wherein the first binding pod comprises a first pulley, the second binding interface pod comprises a second pulley, and comprising rotationally linking the first pulley to the second pulley with a belt.

19. The method of claim 11 wherein the first binding pod comprises a first pulley, the second binding interface pod comprises a second pulley, and comprising rotationally linking the first pulley to the second pulley with a chain.

20. An apparatus for turning a sport board in response to foot dorsiflexion and plantarflexion, comprising:

a first binding interface pod configured to be mounted on a longitudinal centerline of the board proximate to a first distal end, the first binding interface pod comprising a first axis pivotable first top plate configured to be positioned above a top of the board and a second axis rotatable first steering fin configured to extend from a bottom of the board, wherein the first axis is orthogonal to the second axis, the pivotable first top plate linked to the first steering fin such that the first steering fin counter-rotates in response to pivoting of the first top plate and rotates in response to counter-pivoting of the first top plate;

a second binding interface pod configured to be mounted on the longitudinal centerline of the board in alignment with the first binding interface pod and proximate to a second distal end, the second binding interface pod comprising a third axis pivotable second top plate configured to be positioned above the top of the board and a fourth axis rotatable second steering fin configured to extend from the bottom of the board, wherein the third axis is orthogonal to the fourth axis, the pivotable second top plate linked to the second steering fin such that the second steering fin rotates in response to pivoting of the second top plate and counter-rotates in response to counter-pivoting of the second top plate; and a linkage that connects the first top plate with the second top plate such that the second top plate pivots responsive to pivoting of the first top plate and counter-pivots responsive to counter-pivoting of the first top plate, whereby alternating pivoting and counter-pivoting of the rotatable first top plate and second top plate with dorsiflexion and plantarflexion of first and second feet of a rider causes the sport board to be steered in S-shaped turns.

* * * * *